United States Patent [19]

Hotimsky

[11] 4,407,458

[45] Oct. 4, 1983

[54] DEVICE FOR MOUNTING AND BALANCING THE ROTARY KNIVES OF A CUTTER MACHINE

[76] Inventor: Eric R. Hotimsky, 24, allée des châlets, 93320 Les Pavillons Sous Bois, France

[21] Appl. No.: 321,635

[22] Filed: Nov. 16, 1981

[30] Foreign Application Priority Data

Nov. 17, 1980 [FR] France ..... 80 24374

[51] Int. Cl.[3] ..... B02C 18/16

[52] U.S. Cl. ..... 241/282.1; 241/292; 241/292.1

[58] Field of Search ..... 83/654, 655, 664, 665, 83/699; 241/282.1, 282.2, 292, 292.1

[56] References Cited

U.S. PATENT DOCUMENTS 4,211,371 7/1980 Hotimsky ..... 241/292.1 X

*Primary Examiner*—Mark Rosenbaum

*Attorney, Agent, or Firm*—Browdy and Neimark

[57] ABSTRACT

The massive central portion of the knife is formed with an opening of substantially rectangular shape for inserting a boss of square shape integral with a support-washer in turn formed with an opening the shape of which is identical to that of the machine shaft. The boss has an eccentric hole for cooperating with a finger of a stabilizer holding washer provided with a sleeve on which comes the balancing washer of circular shape but having in its center a recess of oblong shape.

6 Claims, 17 Drawing Figures

DEVICE FOR MOUNTING AND BALANCING THE ROTARY KNIVES OF A CUTTER MACHINE

BACKGROUND OF THE INVENTION

The present invention relates to a mounting and balancing device for setting and locking in position knives used in machines for cutting, crushing and chopping food products, particulaly in pork-butchery and for salted products, these machines comprising a number of knives arranged on an axis rotating at high speed in a tank of generally semi-toric shape. The knives are in a spaced-apart relationship at angles of 180°, or 120°, or 90°, or 60°, or 30°, according to the number of knives, along one single line.

As is known, the rotary speed of the knives in modern-machines, so-called cutter machines, is extremely high since there exists machines rotating normally at 3,000 to 6,000 r.p.m. Such speeds have brought about phenomena which hitherto were negligible but are now the source of serious hazards. Actually, the centrifugal force generated by the rotation of the knives reaches very high values tending to displace them relative to the shaft on which they are mounted and, in spite of the precautionary measures taken, some of the knives are displaced, with all the disastrous consequences involved that can be imagined since said knives come in contact with the machine tank, break, deeply score said tank and are in danger to be transformed into projectiles extremely dangerous for the surrounding personnel. On the other hand, the metallic splinters make the products being treated unusable and the price of such unusable products is high since several hundreds of kilogrammes are often treated in one single working pass.

One should also note that the very high rotation speed generates vibrations if the knives are not carefully balanced. Actually, the weights of new knives are little different, but substantial deviations inevitably appear after a few sharpenings, which can reach differences of a several tens of grammes. Vibrations which are thus caused bring about a general fatigue of the machine, the deterioration of the bearings of the knife holding shaft and a deafening noise in the work-shop with as consequence painful conditions for the operators.

Attempts have already been made to remedy such disadvantages with various mechanical solutions regarding the suppression of the displacement of the knives under the effect of the centrifugal force as well as the vibrations due to the lack of balance by using complementary re-balancing devices. However, the existing devices exhibit usually, together or separately, various disadvantages or limitations to their use, such as a high price, reduced setting possibilities, limited balancing possibilities, restrictions as to the choice of the number of knives used and the way to arrange them on the knife holding shaft, etc.

The present invention remedies such drawbacks by providing a balancing and clamping device ensuring complete safety.

SUMMARY OF THE INVENTION

According to the invention, in the massive central portion of the knife is formed an opening of substantially rectangular shape for the positioning of a square-shaped boss rigidly integral with a support-washer, said support-washer being formed with an opening the shape of which corresponds to that of the machine shaft, the boss having an eccentric hole for cooperating with a finger, a stabilizer holding washer provided with a sleeve on which comes to rest the balancing washer of circular shape but formed in its center with an opening of oblong shape, thereby providing the possibility of eliminating the wants of balance for balancing for the knives mounted on the machine shaft.

According to another feature of the invention, there is placed between the boss of the support-washer and one of the sides of the knives opening a wedge or insert appropriately adjusted, said insert being then locked by a locking element or bolt while the boss of the support-washer is also locked by a locking element or bolt.

Various other features of the invention will besides become more apparent from the following detailed description.

BRIEF DESCRIPTION OF THE DRAWINGS

An embodiment of the invention is shown by way of non limitative example in the accompanying drawings, wherein.

DESCRIPTION OF A PREFERRED EMBODIMENT

Figure 1:
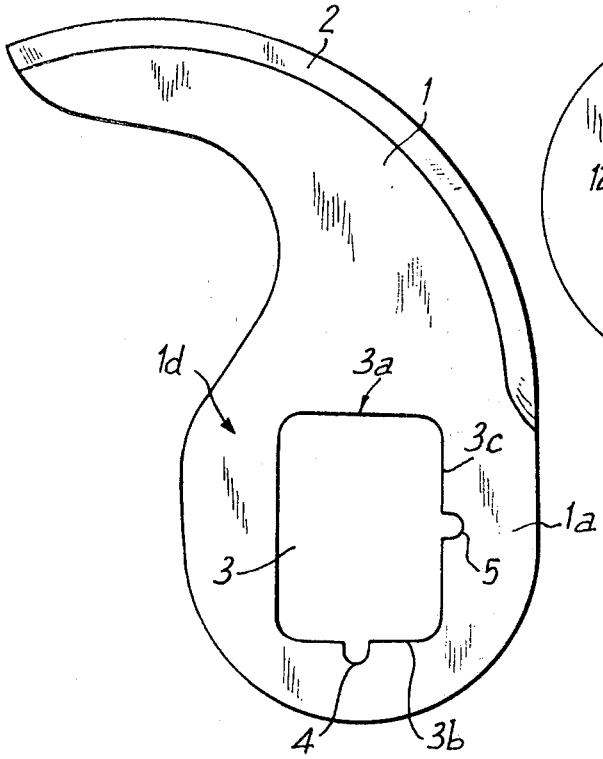
FIG. 1 is an elevation view of a knife according to the invention.

In FIG. 1 is shown a knife, so-called cutter-knife 1, of a conventional shape, the sharp edge of the knife being designated at 2. The massive central portion 1*d* of the knives comprises an opening 3 of substantially rectangular shape, but the side 3*b* of which is not parallel to the opposite side 3*a* but, on the contrary, diverges from right to left relative to side 3*b*. Semicircular cut-outs 4, 5 are provided in the median zone of the sides 3*b*, 3*c* of the opening 3.

Figure 2:
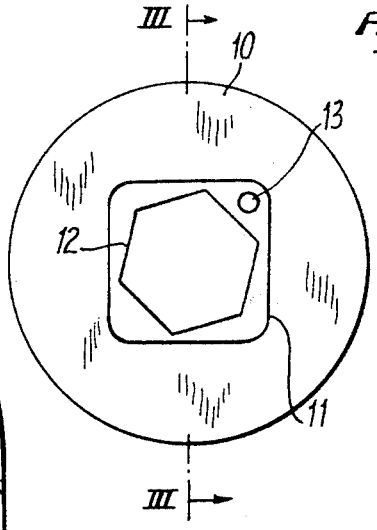
FIG. 2 is a plan view of a knife support-washer.
Figure 3:
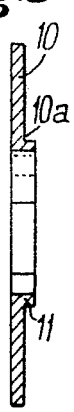
FIG. 3 is a sectional view along line III—III of FIG. 2.

In FIG. 2 is shown a cylindrical support-washer 10 the central portion 10*a* of which comprises an over-thickness or boss 11 formed with a six-sided opening 12 corresponding to the section of the machine driving shaft. Moreover, the boss 11 is formed with an opening 13 the purpose of which will be explained hereafter. An opening of any other shape could be used instead of the six-sided hole 12.

Figure 4:
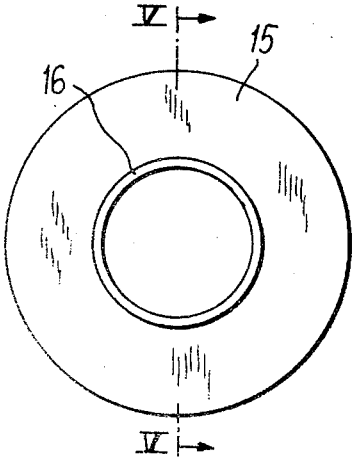
FIG. 4 is a plan view of a stabilizer holding washer.
Figure 5:
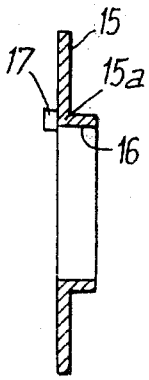
FIG. 5 is a sectional view along line V—V of FIG. 4.

In FIG. 4 is shown a stabilizer holding circular washer 15 the central portion 15*a* of which forms a sleeve 16. A stud 17 protrudes from the face of washer 15 which is opposite the sleeve 16, this stud 17 being provided for engaging into hole 13 of the support-washer 10.

Figure 6:
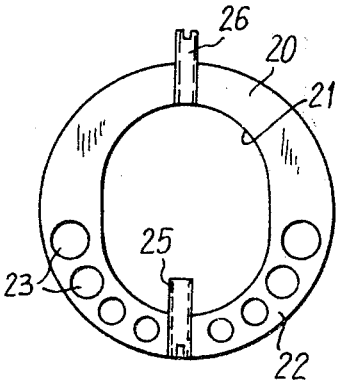
FIG. 6 is a plan view of a balancing washer.
Figure 7:
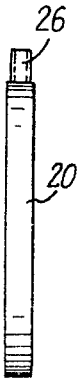
FIG. 7 is a side elevation view corresponding to FIG. 6.
Figure 9:
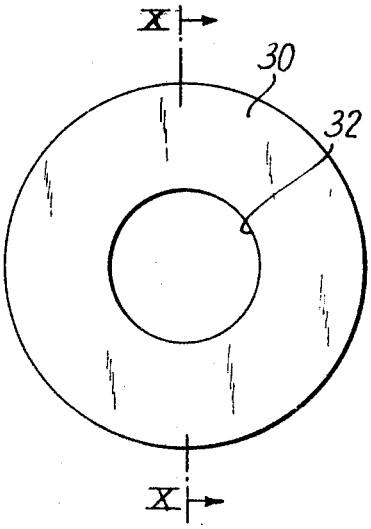
FIG. 9 is a plan view of a mask placed at the end of the knives/support-washer/stabilizer washer assembly.
Figure 10:
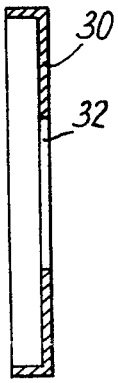
FIG. 10 is a sectional view along line X—X of FIG. 9.

In FIG. 6 is shown a balancing washer 20 of circular shape, but the central portion of which being formed at 21 with an oblong-shaped opening and on its lower portion 22 with holes 23 of various diameters for reducing its weight. Moreover, two tapped studs 25, 26 are provided in diametrally opposite positions. As can be seen in FIG. 9, there is also provided a cover 30 having a section shape similar to that of a cup or basin (see FIG. 10) the central portion of which is formed with a hole 32 for positioning the cover 30 on the machine shaft.

Figure 12:
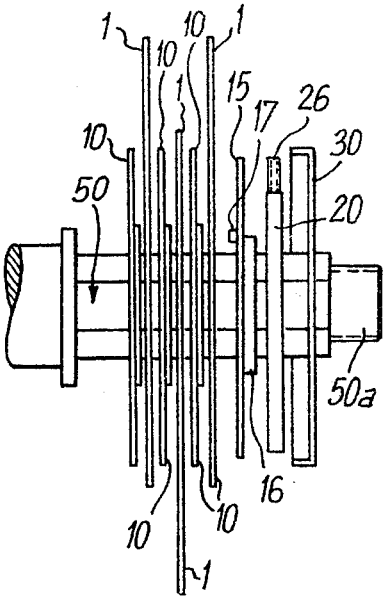
FIG. 12 is a side elevation view of the assembly of knives mounted on the driving shaft of a cutter machine.
Figure 11:
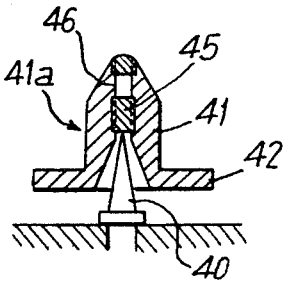
FIG. 11 shows a tool for the positioning and setting in balance of the knives.
Figure 13:
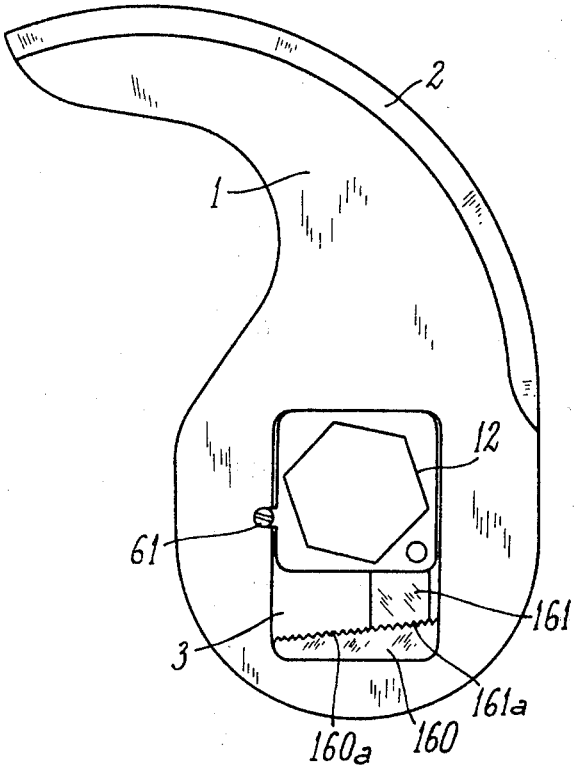
FIGS. 13 and 14*a–d* show a slight modification of the embodiment of a knife locking element.
Figure 14A:
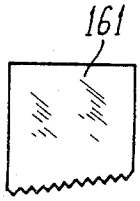
Figure 14B:
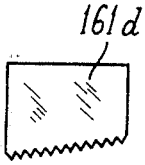
Figure 14C:
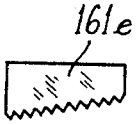
Figure 14D:
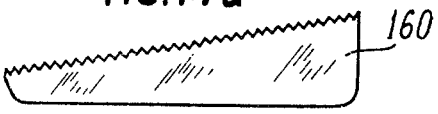

In FIG. 11 is shown a fixed needle 40 supporting a cylindrical frustoconical element 41 having at its base a flange 42. The cylindrical frustoconical element 41 is provided for the mounting, setting and balancing of the knives which are then mounted on shaft 50 (FIG. 12) of a cutter machine. In fact, the cylindrical frustoconical element 41 which is in unstable equilibrium on the pointed end of needle 40 allows the accurate setting of the balance of the knives. Since the threaded cap 45 can be screwed inside the channel 46, it can be displaced in height according to the setting required and thereby adjust the sensitivity of the cylindrical frustoconical element 41. The outer diameter of element 41 corresponds to the diameter of the machine shaft 50.

Figure 8:
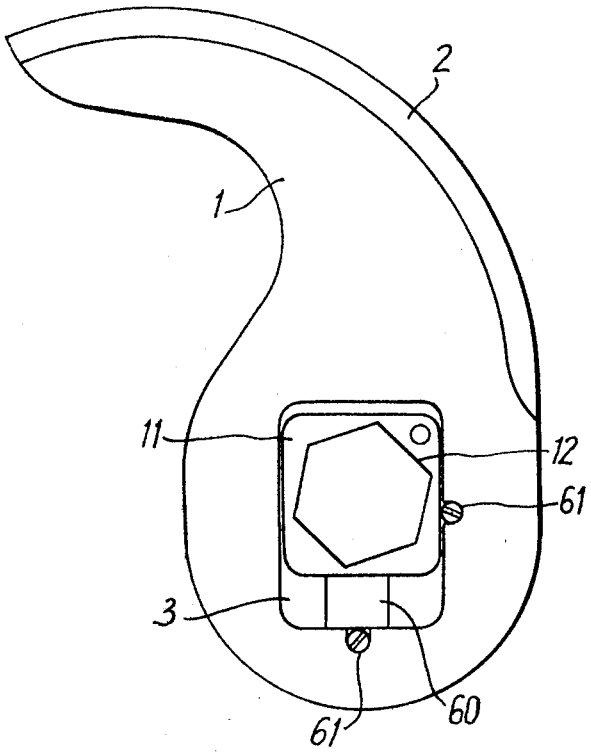
FIG. 8 is an elevation view showing a knife provided with the support-washer.

As shown in FIG. 8, the central boss 11 of a support-washer 10 is placed in the opening 3 of the knife 1 so as to allow placing a knife 1 on the cylindrical frustoconical element 41 the face 41*a* of which comprises six sides as the machine shaft 50. Once the first knife 1 is in position with its support-washer 10, the second knife 1 is placed with its support-washer, off-set by 60° for example relative to the first knife, then the third knife 1 off-set by 60° relative to the second knife, etc., up to the sixth knife 1 (see FIG. 8 and FIG. 12). In the present case, the six knives are angularly spaced apart by 60° on the portion 41*a* of the cylindrical frustoconical element 41. Each knife 1 is clamped by an intermediate element or insert 60 relative to the corresponding washer 10. Insert 60 has a substantially rectangular shape and is adjusted so as to fill the space between the boss 11 and side 3*b* of the opening 3, then locking elements 61 are placed in the cut-outs 4, 5, these locking elements being small cams which can be turned with a screw-driver since they have a slotted head as is shown in FIG. 8. Thereby is obtained an accurate fitting of the knife without running the risk to see it move later on the machine shaft 50 since the locking elements 61 which cooperate with the inserts 60 provide a perfect fixation of this knife on the shaft 50. As for the six-sided openings 12 of the supporting washers 10, the openings of sleeves 13 of the stabilizer holding washers, the oblong-shaped hollowed opening 21 of the balancing washer and the opening 32 of the cover 30 have a size sufficient for the passage of the shaft 50, and the elements can be stacked on each other, it being understood that the six-sided shape could be re-modified if the shaft 50 had another shape, for example a circular shape with a locking device.

Once the positioning of the knives and their adjustment in length on the cylindrical frustoconical element 41 is completed, one proceeds then to balancing the assembly by rotating slowly said assembly which is locked by introducing into the hole 13 of the support-washer 10 of the last knife placed on the shaft of the stud 17 of the stabilizer holding washer 15. The balancing washer 20 is then positioned on the sleeve 16 in its neutral position and, if the assembly of knives 1 appears as not balanced, the balancing washer 20 is placed appropriately so as to compensate the movement of unbalance. At this moment and with the assistance of screws 25, 26, the balancing washer 20 is locked. What is left to do is to position the cover 30 so that the assembly be particularly well balanced and set as regards its disposition and length. From that moment, the knife assembly can be mounted on the shaft 50 of a machine while eliminating all the risks generated by the centrifugal force which has a tendency to displace the knives 1 longitudinally as well as by suppressing any want of balance causing dangerous vibrations to the machine and knives.

Generally, the fixation of the knives assembly on shaft 50 is carried out with the assistance of a locking screw which is screwed on the threaded portion 50*a* of the shaft 50, but other means could also be used.

As appears clearly in FIG. 2, the support-washer 10 which is formed with a square-shaped boss 11 and with a six-sided opening 12 in its center allows using in a simple manner said support-washer for positioning the knives in a spaced-apart relationship of 30°, or 60°, or 90°, or 120°, or 180°, etc. without any other structure modification of the assembly since the combination of a square boss 11 with the six-sided opening provides this positioning in a simple and easy manner. Similarly, the boss 11 provides an excellent guiding means for each knife, the contact surface between the sides of the opening 3 and the boss 11 being more important than that existing presently between the elements for mounting a knife on a six-sided shaft of an existing machine. Thereby is provided a better contact via a larger surface, the fatigue of the shaft 50 is therefore considerably reduced and there is less wear of this shaft and of the ball-bearings maintaining the shaft.

Attention should also be drawn on the fact that the balancing washer 20 is made integrally in one piece, which was not the case with the devices comprising a balancing element since one was led to set the balance with several separate fly-weights, hence on the one hand more trials and errors, and on the other hand a limitation of the out-of-balance compensations to a small value hardly in excess of 20 to 30 grammes. Finally, one should point out that the wedge or insert 60 which is generally made of mild steel easily ground or filed allows an accurate and very quick adjustment even under difficult working conditions.

As is shown in FIGS. 13 and 14*a–d*, one can also replace wedge 60 by two elements 160, 161 having opposite toothings 160*a*, 161*a* placed in register with each other and between the central boss 11, the support-washer 10 and the bottom of the opening 3. Thus by having elements 161, 161*d*, 161*e* of different heights, one can easily block the support-washer 10 whatever the position one wishes to obtain for said washer 10.

There is therefore no necessity, as with the element 60, to carry out a removal of material for setting the knife 1 when worn out, as is the case for example after having re-sharpened it.

I claim:

1. A mounting and balancing device for rotary knives of a cutter machine, wherein the machine has a shaft of a predetermined cross-sectional shape, each of the knives including a massive central portion formed with an opening of substantially rectangular shape, a support washer including a boss of square shape for introduction into each of said knife openings, said support-washer being formed with an opening the shape of which is identical to that of the shaft of the machine, said boss including an eccentric hole, a stabilizer holding washer having a sleeve and a finger for cooperating with said eccentric hole, and a single balancing washer of circular shape having in its center a non-circular opening for mounting said balancing washer on said sleeve to thereby offset any unbalance of the knives mounted on the shaft of the machine.

2. A mounting and balancing device according to claim 1, wherein a wedge is placed between the boss of the support-washer and one of the sides of the opening of the knives, said wedge being adjustable and lockable by a locking element while the boss of the support-washer is also capable of being locked by a locking element.

3. A mounting and balancing device according to claim 1, wherein the single balancing washer is formed with a central opening of oblong shape thereby permitting freedom of displacement on the shaft of the machine.

4. A mounting and balancing device according to claim 1 wherein a portion of the single balancing washer is formed with holes for making it lighter.

5. A mounting and balancing device according to claim 1, wherein the single balancing washer comprises two mobile screws, said screws enabling, through their displacement, locking of the single balancing washer in a position providing a compensation for the unbalance and thereby balance the rotary knives of the cutter machine.

6. A mounting and balancing device according to claim 1, wherein the opening formed in the massive central portion of each knife has a substantially rectangular shape with one pair of adjacent sides of the opening defining therebetween an angle of more than 90° thereby enabling an easy insertion of the appropriately adjusted wedge.

* * * * *